US009702226B2

(12) United States Patent
Diaj et al.

(10) Patent No.: US 9,702,226 B2
(45) Date of Patent: Jul. 11, 2017

(54) BOOSTER EXPLOSIVE SUPPORT DEVICE FOR ANCHORING AN EXPLOSIVE BOOSTER IN A BOREHOLD

(71) Applicant: International Technologies, LLC, Elkins, WV (US)

(72) Inventors: Sacha Philip Diaj, Lexington, KY (US); Nils Alberto Heinke, Elkins, WV (US)

(73) Assignee: International Technologies, LLC WV (US)

( * ) Notice: Subject to any disclaimer, the term of this patent is extended or adjusted under 35 U.S.C. 154(b) by 379 days.

(21) Appl. No.: 14/374,398

(22) PCT Filed: Dec. 5, 2012

(86) PCT No.: PCT/IB2012/056986

§ 371 (c)(1),
(2) Date: Jul. 24, 2014

(87) PCT Pub. No.: WO2013/110982

PCT Pub. Date: Aug. 1, 2013

(65) Prior Publication Data

US 2015/0176371 A1 Jun. 25, 2015

(30) Foreign Application Priority Data

Jan. 25, 2012 (ZA) ..... 2012/00644

(51) Int. Cl.
*E21B 23/01* (2006.01)
*E21B 41/00* (2006.01)
(Continued)

(52) U.S. Cl.
CPC ..... *E21B 41/00* (2013.01); *E21B 23/01* (2013.01); *F42B 3/26* (2013.01); *F42D 1/22* (2013.01)

(58) Field of Classification Search
CPC .. E21B 23/01; E21B 41/00; F42B 3/26; F42B 3/00; F42D 1/22
See application file for complete search history.

(56) References Cited

U.S. PATENT DOCUMENTS 711,545 A 10/1902 Thomson
1,763,407 A 6/1930 Niesen
(Continued)

FOREIGN PATENT DOCUMENTS

DE 102004016663 A1 * 10/2005 ..... F42B 3/00
GB 649806 A * 1/1951 ..... F42B 3/00
(Continued)

*Primary Examiner* — Daniel P Stephenson
(74) *Attorney, Agent, or Firm* — Baker & Hostetler LLP

(57) ABSTRACT

This invention relates to a booster explosive support device 10 for use in boreholes 87. The device 10 includes a securing arrangement 12 which is configured to secure an explosive booster 100 to the device 10, and a spacing element 39 which protrudes from the securing arrangement 12. The spacing element 39 has a free end which in use abuts against a closed end or bottom of a borehole, thereby supporting the securing arrangement 12 and hence an explosive booster 100 at a desired spacing from the bottom of the borehole 87. The spacing element 39 may be elongate. The invention also relates to a method of securing an explosive booster 100 at a pre-determined position in a borehole 87. The method includes spacing the explosive booster 100 away from a closed end of the borehole 87 by supporting the explosive booster 100 from an operatively lower position thereof.

19 Claims, 11 Drawing Sheets

(51) Int. Cl.
*F42B 3/26* (2006.01)
*F42D 1/22* (2006.01)

(56) References Cited

U.S. PATENT DOCUMENTS 2,425,472 A * 8/1947 Hodgson ..... F42B 3/26 102/331
3,118,374 A 1/1964 Karpovich
3,431,848 A * 3/1969 Foster ..... C06B 47/14 181/116
4,037,536 A * 7/1977 Griffith ..... F42B 3/00 102/331
4,485,741 A 12/1984 Moore et al.
4,487,129 A 12/1984 Isaac
4,667,599 A 5/1987 Brand
4,993,324 A 2/1991 Stefanye
5,435,250 A * 7/1995 Pollock ..... F42B 3/00 102/317
5,763,816 A * 6/1998 Keeling ..... F42B 3/00 102/275.11
5,780,764 A * 7/1998 Welch ..... F42D 1/043 102/275.4
5,917,142 A 6/1999 Chang
6,684,791 B1 * 2/2004 Barnhart ..... F42B 3/00 102/307
9,115,963 B2 * 8/2015 Most ..... F42B 3/26
2011/0017088 A1 1/2011 Steadman, Sr.
2012/0145027 A1 6/2012 Martin
2015/0176371 A1 * 6/2015 Diaj ..... F42B 3/26 166/381

FOREIGN PATENT DOCUMENTS

IT EP 2177866 A1 * 4/2010 ..... F42B 3/26
WO WO 2009/109008 9/2009
WO WO 2016020875 A2 * 2/2016 ..... F42B 1/00

* cited by examiner

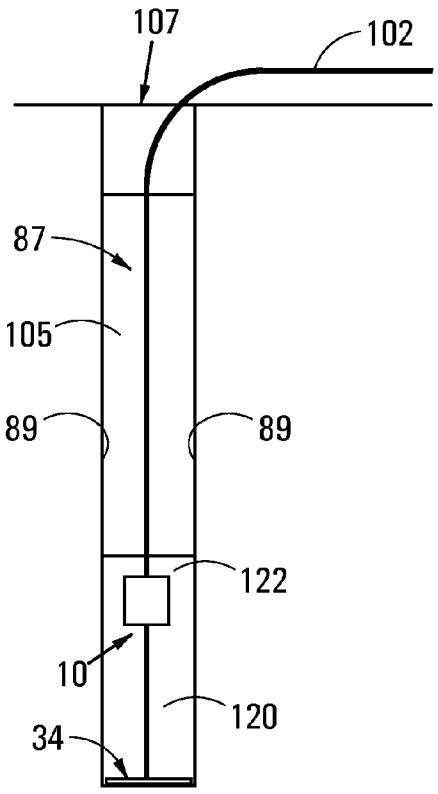
FIG 4.3
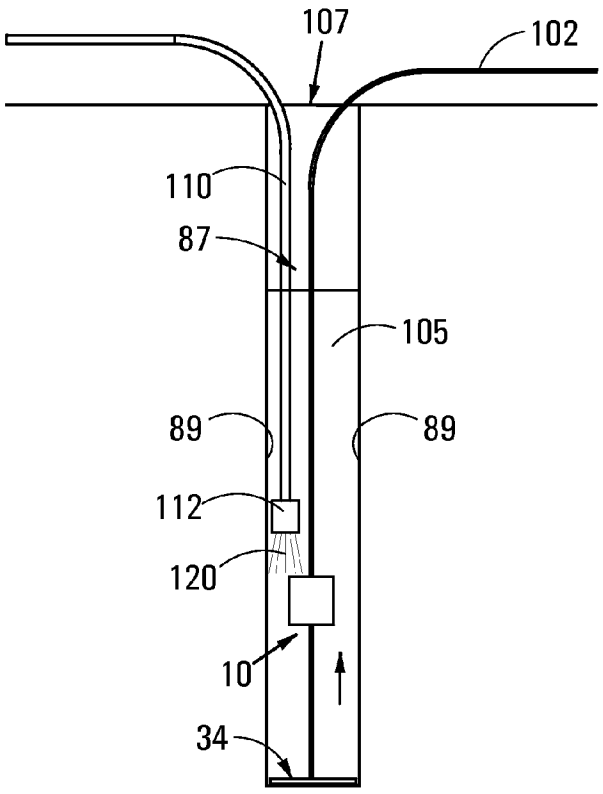
FIG 4.2
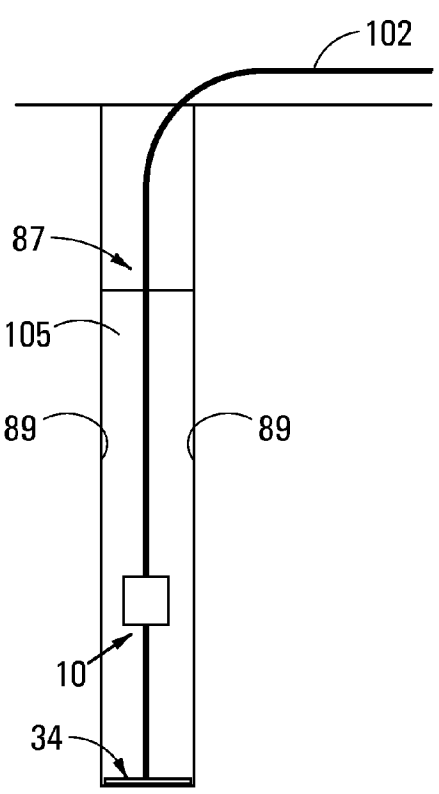
FIG 4.1

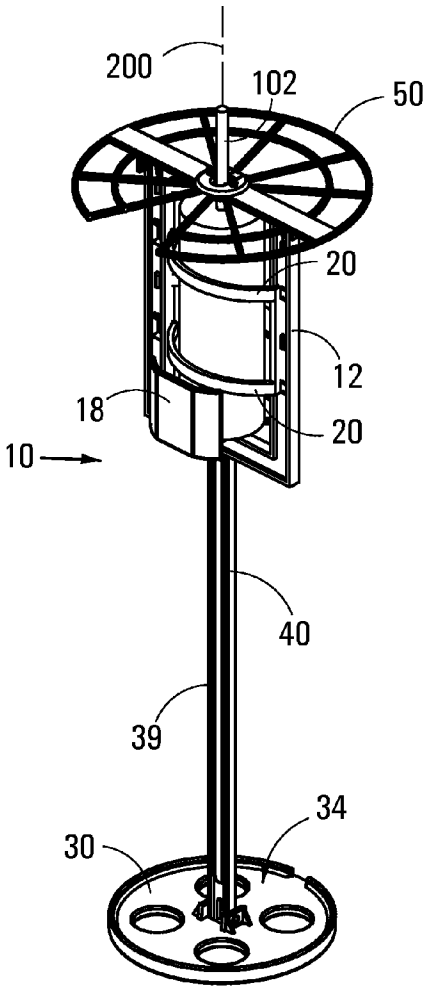
FIG 5.2
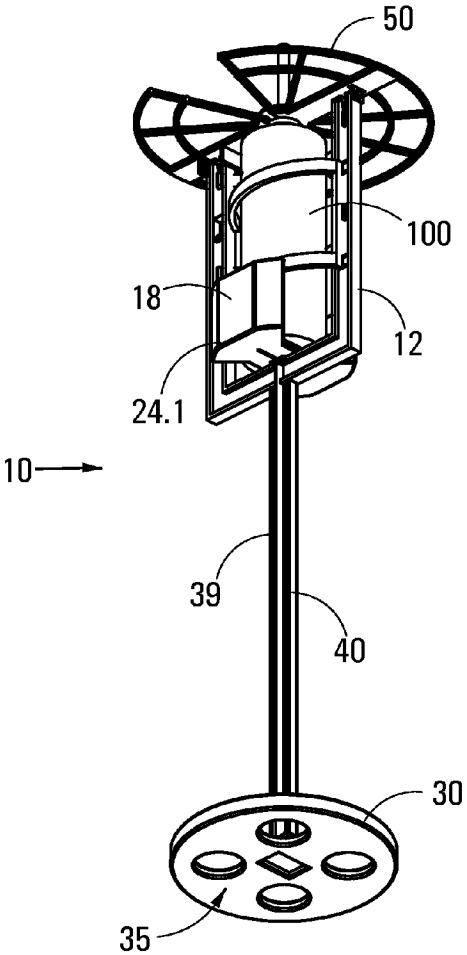
FIG 5.1

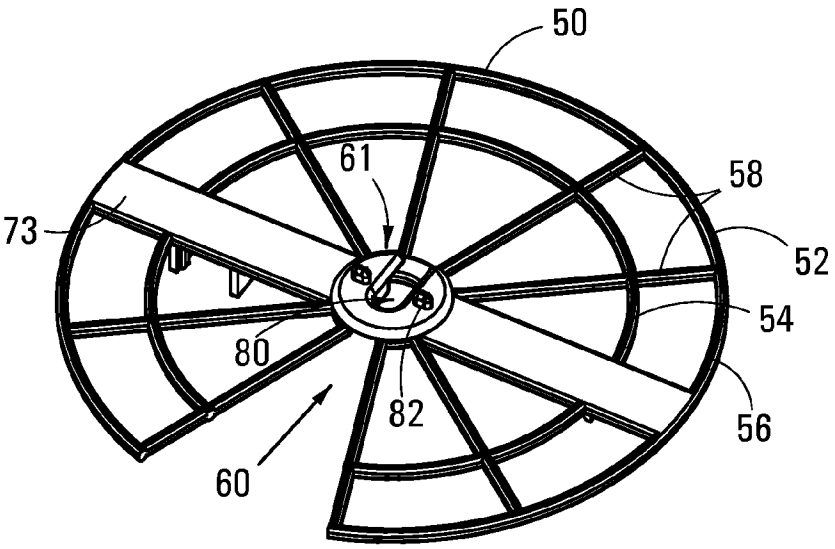
FIG 6.2
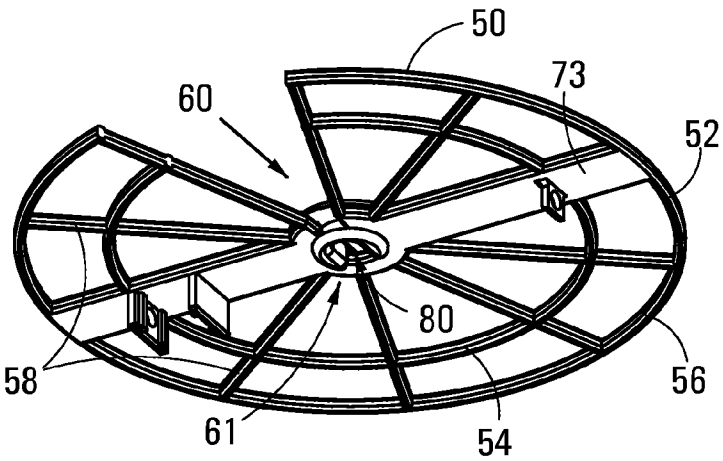
FIG 6.1

BOOSTER EXPLOSIVE SUPPORT DEVICE FOR ANCHORING AN EXPLOSIVE BOOSTER IN A BOREHOLD

CROSS-REFERENCE TO RELATED APPLICATIONS

This application is the National Stage of International Application No. PCT/IB2012/056986, filed Dec. 5, 2012, which claims the benefit of South African application number 2012/00644, filed Jan. 25, 2012, the disclosures of which are incorporated herein by reference in their entireties.

FIELD OF INVENTION

This invention relates to a booster explosive support device for use in boreholes which are drilled for the purpose of loading them with explosives.

BACKGROUND OF THE INVENTION

In mining operations explosives are loaded into boreholes. The explosive is detonated by means of a detonator positioned in the explosive. Ideally, the boreholes are primed and initiated at or towards a bottom/closed end of the borehole. In the case of bulk loaded explosives such as emulsion based explosives and ANFO, primers or boosters with an embedded or attached detonator are lowered into the borehole and pulled slightly off the bottom end of the borehole (out of the drill cutting or mud). The primary explosives are then loaded into the borehole.

At the bottom end of the borehole, gasses are confined enabling an explosive column provided in the borehole to do the most work when the explosives are detonated, before equalizing to ambient conditions. The placement of primers or boosters in a borehole accordingly plays an important role in the results obtained from the explosion.

Boosters or primers are cap-sensitive explosives typically packaged in cylindrical form. They are made of high velocity, high energy explosive material that has the capability to detonate commonly used bulk/primary explosives in the mining industry. By being cap-sensitive, they can be initiated themselves by lower energy detonators activated through a downline (such as detonator cord or shock tube). The primer or booster must have sufficient energy to initiate the detonation reaction in the explosive column and sustain it until the primed explosive produces enough energy to support the detonation reaction by itself.

It is known and proven through numerous field and laboratory tests that when a borehole, containing water, is bottom-pumped by primary explosives, the booster that was initially lowered to the bottom of the borehole by a downline, is pushed upward in the borehole by the displaced water initially and further by the rising explosive column, thus removing the primer or booster from the preferred location near the bottom end of the borehole. There is no control under these conditions as to how far the primer or booster will be lifted up the explosive column, but it is generally accepted that it would end up at the upper third of the explosive column. With the primer or booster now located at the top third of the explosive column, the initiation of the explosive column occurs near the top of the borehole. This occurrence is known as top priming.

When an explosive-filled borehole is top primed, the top of the borehole explodes, releasing gasses and often causing air blast or possibly the production of dangerous flying rocks. There is also a danger of losing the explosive confinement at the top of the borehole, thus reducing the effectiveness of the explosive column in breaking the rocks and negatively affecting the fragmentation produced by the blast.

One known solution which tries to address this problem is by making use of a weight (e.g. a brick) that is provided with a central hole that allows for a string to pass through the hole and secure the brick to a primer or booster by attaching the string to the booster. Another known solution is by making use of a small bag made out of netting material which is filled with small rocks to provide a weight which is sufficient to keep it at the bottom of a water-containing borehole. The bag is attached to the primer or booster by means of a string. Both of these solutions are impractical since they are slow to put together in the field and heavy to carry with the booster to every borehole on a mining bench that may typically have 100 to 250 boreholes (even as high as 500 boreholes).

A further problem of which the Inventors are aware is that a booster lowered into a borehole tends to end up against a side wall of the borehole due to the fact that the operator that lowers the booster, stands at a side of the borehole thus resulting in the downline, via which the booster is lowered, travelling over an upper edge of the borehole opening. The booster is therefore lowered along a sidewall of the borehole. In this position, an operatively lateral booster surface in close proximity with the sidewall will not be sufficiently surrounded by primary explosive materials and as a result part of the explosion's released energy will be utilized to break rock rather than initiating the explosive column.

The communication between an electronic detonator located in the borehole (embedded in the booster) and its control centre or blasting machine which is located on the surface, is accomplished through a very thin downline. Currently, mines are experiencing a high number of breaks in communication between electronic detonators and their control centres.

It is understood that the breaks in communication are mainly caused by the tension that the downline is subjected to, due to the fact that the booster and detonator are hanging at the end of the downline, and are pulled towards the bottom end of the borehole by the settling of the explosive column that was placed in the borehole after the booster and electronic detonator were placed in the borehole.

The settling of the explosive column inside the borehole and the consequential pulling and tensioning of the downline can result in a communication break in the downline due to stemming material, consisting of drill cuttings that may in turn contain small and sharp rocks or crushed rocks, that is placed/positioned above the explosive column and surrounds the downline. The stemming material may cut or crimp the high tension downline to the point of damaging its integrity and cutting off the communication line between the electronic detonator at the bottom of the borehole and the control centre at the surface.

Furthermore, the downline connected to the detonator is threaded from top to bottom through an open-ended tunnel-like hole in the booster and then pushed back up into a closed-ended parallel tunnel-like hole. This arrangement creates a U-shaped turn in the downline at the bottom of the booster which is made of hard non-flexible material. Due to the settling of the explosive column, the hanging booster will be pulled down towards the bottom end of the borehole. The net effect is that the downline may suffer a crimping effect at the U-shaped turn area at the bottom of the booster. This crimping effect has the potential of squeezing the downline to the point of cutting off the communication from the control centre to the detonator.

The above scenario is likely to be encountered in dry holes where straight ANFO is utilized, as well as water filled holes loaded with non-pumpable explosive blends such as a ratio of emulsion: ANFO of up to 50:50. It is not likely to be encountered in water filled holes that are pumped and that have an emulsion: ANFO ratio of 60:40 and above. This is due to the fact that the booster/detonator combination will more than likely float upwards towards the top of the borehole, thus reducing tension in the downline.

It is an object of this invention to provide means which the Inventors believe will at least alleviate at least some of these problems.

SUMMARY OF INVENTION

For the purposes of this specification the term "operative" refers to when the booster explosive support device (mentioned below) is used in a borehole. Furthermore, the term "operatively lower" refers to a position in a borehole which is closer to a closed end of the borehole, when compared to an "operatively upper" position which is closer to an open end of the borehole.

In accordance with a first aspect of the invention there is provided a booster explosive support device for use in boreholes, the device including:

a securing arrangement configured to secure an explosive booster to the device; and a spacing element which protrudes from the securing arrangement, the spacing element having a free end which in use abuts against a closed end or bottom of a borehole thereby supporting the securing arrangement and hence an explosive booster at a desired spacing from the bottom of the borehole.

The spacing element may be elongate. The spacing element may also be length-adjustable in order to allow the distance/spacing between the securing arrangement and the free end of the spacing element to be adjusted. The elongate spacing element may include an elongate stem, one end of which is connected to the securing arrangement; and a foot or anchor formation connected to the other end of the stem. The foot or anchor formation may define an operatively upper anchor surface onto which primary explosive material can be introduced when the device is positioned in a borehole, in order to aid in securing/anchoring the device in the borehole.

The anchor formation may be located at an operatively lower end of the stem. Similarly, the securing arrangement may be located at an operatively upper end of the stem.

The anchor formation may include an anchor body defining the anchor surface and at least one hole which extends through the anchor body from the anchor surface. Preferably, the anchor body may define a plurality of holes. The anchor formation may be displaceably attached to the stem in order to render the anchor formation displaceable relative to the stem between an operative condition where the anchor surface faces an operatively upper direction and a stored condition where the anchor surface faces a direction transverse to the operatively upper direction. More specifically, the anchor formation may be pivotally attached to the stem. The anchor surface may extend in a plane which is parallel to a longitudinal axis of the stem, when the anchor formation is in its stored condition. The anchor body may be flat.

The securing arrangement may include a securing body and a holder, defining a holding space, which is displaceably mounted to the securing body in order to allow displacement of the holder relative to the securing body between a loading position where an explosive booster can be loaded/introduced into the holding space and a closed position in which the explosive booster is held captive in the holding space. More specifically, the holder may be rotatably mounted to the securing body. Ideally, the holder may be rotatably mounted to the securing body about an axis of rotation which is parallel to a longitudinal axis of the spacing element or the stem thereof. The holder may be elongate, when seen in axial view along the axis of rotation of the holder. More specifically, when seen in axial view along the axis of rotation of the holder, the holder may be rotatable to a stored position wherein a longitudinal axis of the holder is parallel to a plane in which the operatively upper anchor surface of the anchor formation extends, when the anchor formation is in its stored condition.

The securing arrangement may include at least one strap for securing an explosive booster to the booster explosive device. More specifically, the at least one strap may be used to secure an explosive booster in the holding space.

The booster support device may include a locating arrangement including a body having an operatively lateral locating surface which serves to locate the booster explosive support device in a borehole, i.e. by engaging with a sidewall of the borehole as the device is lowered down the borehole. The body of the locating arrangement may be flat and may, in use, extend in a plane which is perpendicular to a longitudinal axis of the spacing element or the stem thereof. More specifically, the locating arrangement may be pivotally connected to the securing arrangement in order to allow displacement of the locating arrangement relative to the securing arrangement between an operative condition whereby the locating body extends in a plane which is perpendicular to the longitudinal axis of the spacing element or the stem thereof; and a stored condition whereby the locating body extends in a plane which is parallel to the longitudinal axis of the spacing element or the stem thereof.

The locating arrangement may be connected to the securing arrangement and positioned above an operatively upper portion thereof, the locating arrangement defining a hole through which a downline may be introduced which, in use, leads to, and is connected to, a detonator which is located close to, or embedded in, an explosive booster which is secured to the securing arrangement. More specifically, the locating arrangement may define a path leading to the hole and may include a locking formation which is movable between an open position whereby the locking formation allows access to the hole via the path and a closed/locked position whereby access to the hole via the path is inhibited. The locating arrangement may be connected to an operatively upper end of the securing body, and may be positioned above the holding space.

The booster explosive support device may have a weight which will cause it to sink in water. In particular, it may be made of a material which has a greater density than water, or of two or more materials which, in combination, have a greater density than water.

In accordance with a second aspect of the invention there is provided a method of securing an explosive booster at a pre-determined position in a borehole, the method including spacing the explosive booster away from a closed end of the borehole by supporting the explosive booster from an operatively lower position thereof.

More specifically, the spacing of the explosive booster away from the closed end of the borehole may be achieved by positioning a spacing element between the booster and the closed end of the borehole.

A spacing distance of the explosive booster from the closed end of the borehole may correspond to the pre-determined position in which the explosive booster is required to be in.

The method may more specifically relate to a method of securing an explosive booster and detonator at a pre-determined position in a borehole.

The detonator may be an electronic detonator.

In accordance with a third aspect of the invention there is provided a method of securing an explosive booster at a pre-determined position in a borehole, the method including positioning the explosive booster in a booster explosive support device as described above and positioning the booster explosive support device in the borehole.

BRIEF DESCRIPTION OF THE DRAWINGS

The invention will now be described, by way of example, with reference to the accompanying diagrammatic drawings. In the drawings:

FIG. 4.1 shows a sectional side view of a borehole (partially filled with water), with the booster explosive support device of FIG. 1, in an operative condition, positioned therein;

FIG. 4.2 shows a sectional side view of the borehole and booster explosive support device of FIG. 4.1, where primary explosive material is introduced into the borehole;

FIG. 4.3 shows a sectional side view of the borehole and booster explosive support device of FIG. 4.2, where the primary explosive material has been discharged into the borehole to form an explosive column;

FIG. 5.1 shows a three-dimensional view from below of the booster explosive support device of FIG. 1 in an operative condition;

FIG. 5.2 shows a three-dimensional view from above of the booster explosive support device of FIG. 5.1;

FIG. 6.1 shows a three-dimensional view of a locating arrangement of the booster explosive support device of FIG. 1;

FIG. 6.2 shows another three-dimensional view of the locating arrangement of FIG. 6.1;

DETAILED DESCRIPTION OF PREFERRED EMBODIMENT

Figure 1:
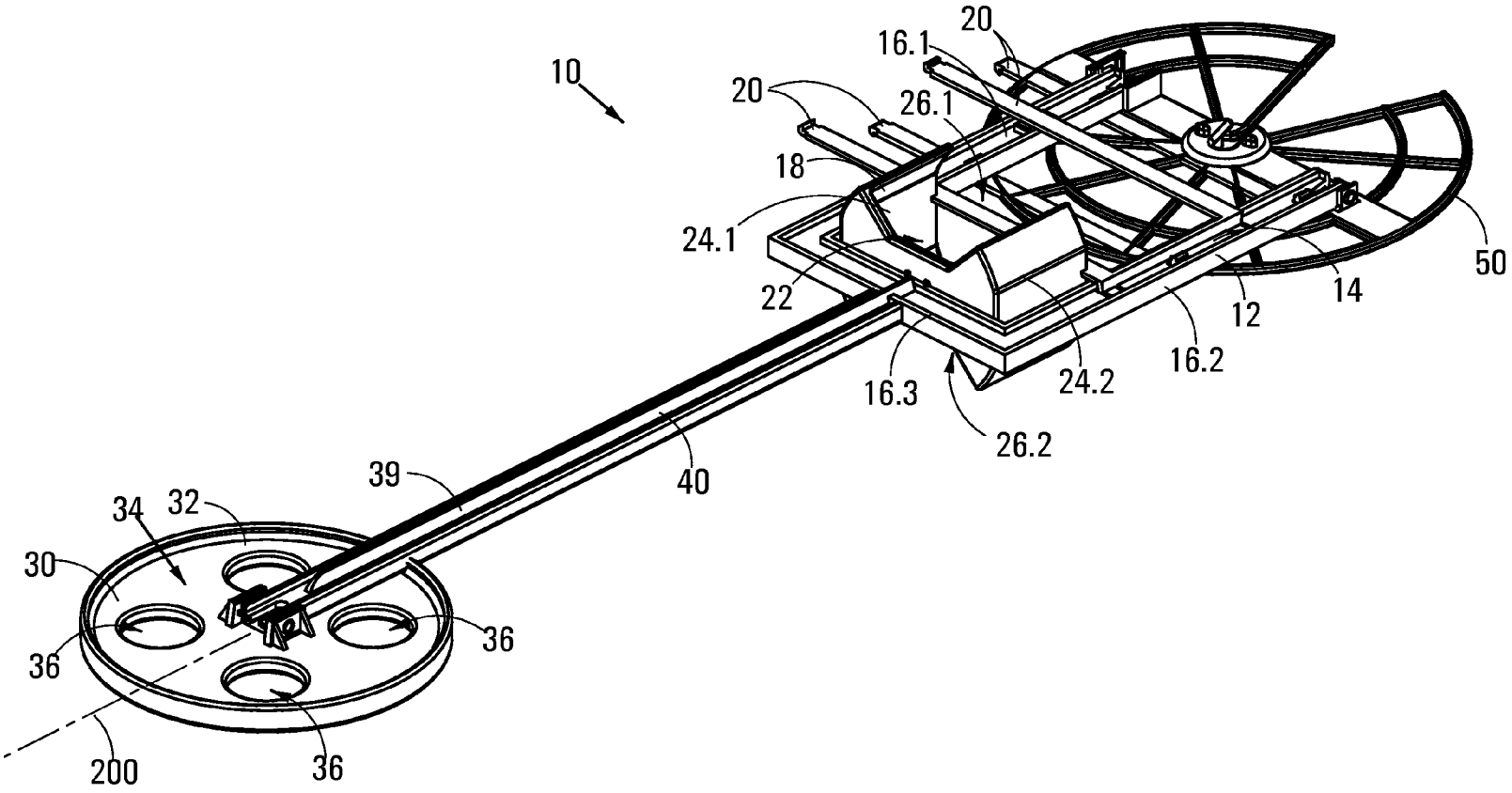
FIG. 1 shows a three-dimensional view of a booster explosive support device in accordance with the invention, in an inoperative, stored condition.
Figure 2:
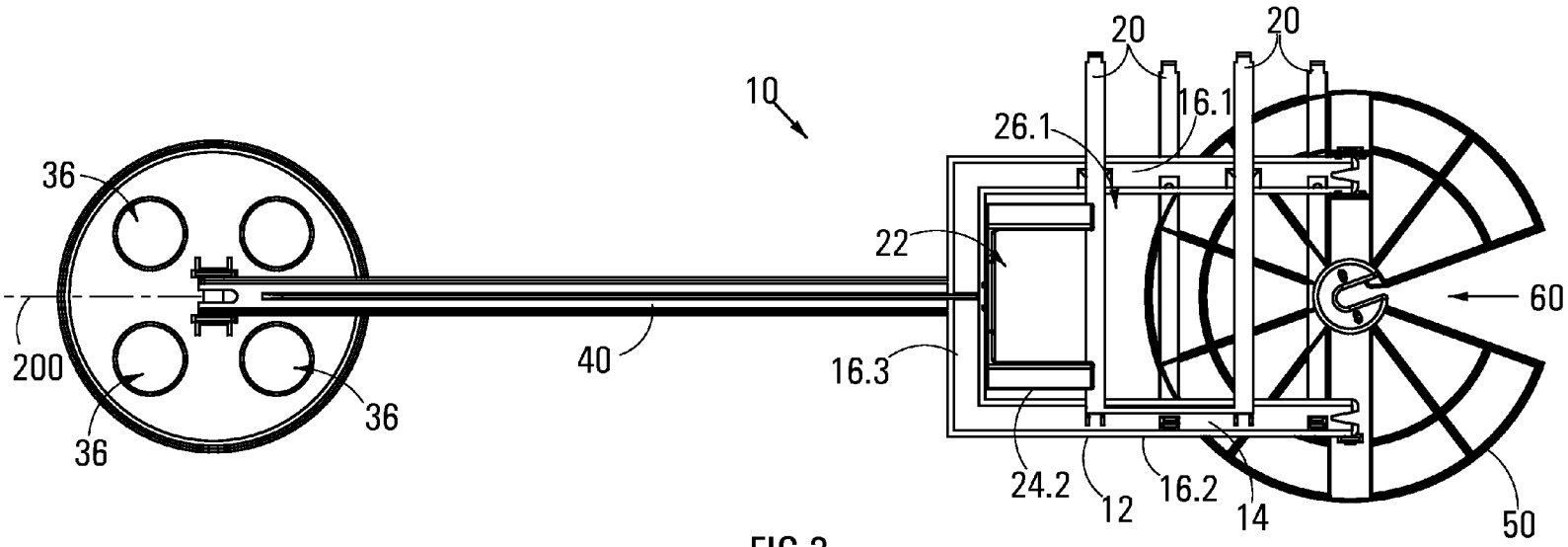
FIG. 2 shows a top view of the booster explosive support device of FIG. 1.
Figure 3:
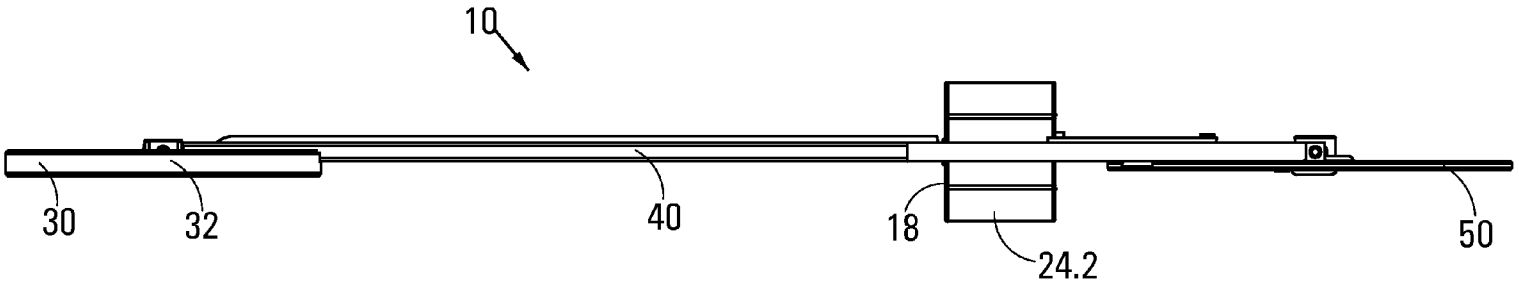
FIG. 3 shows a side view of the booster explosive support device of FIG. 1.
Figure 7:
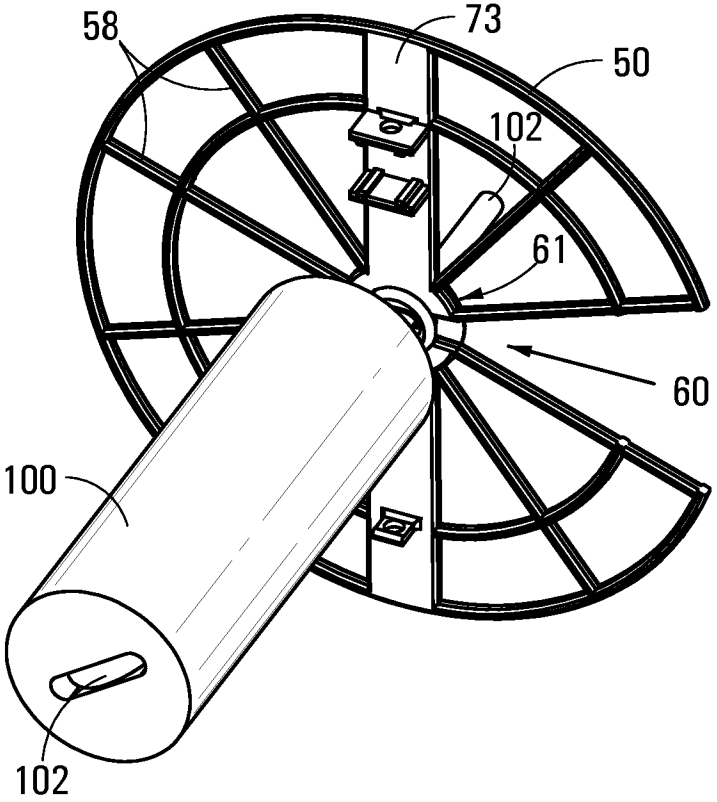
FIG. 7 shows a three-dimensional view of the locating arrangement of FIGS. 6.1 and 6.2, together with a downline and booster.
Figure 8:
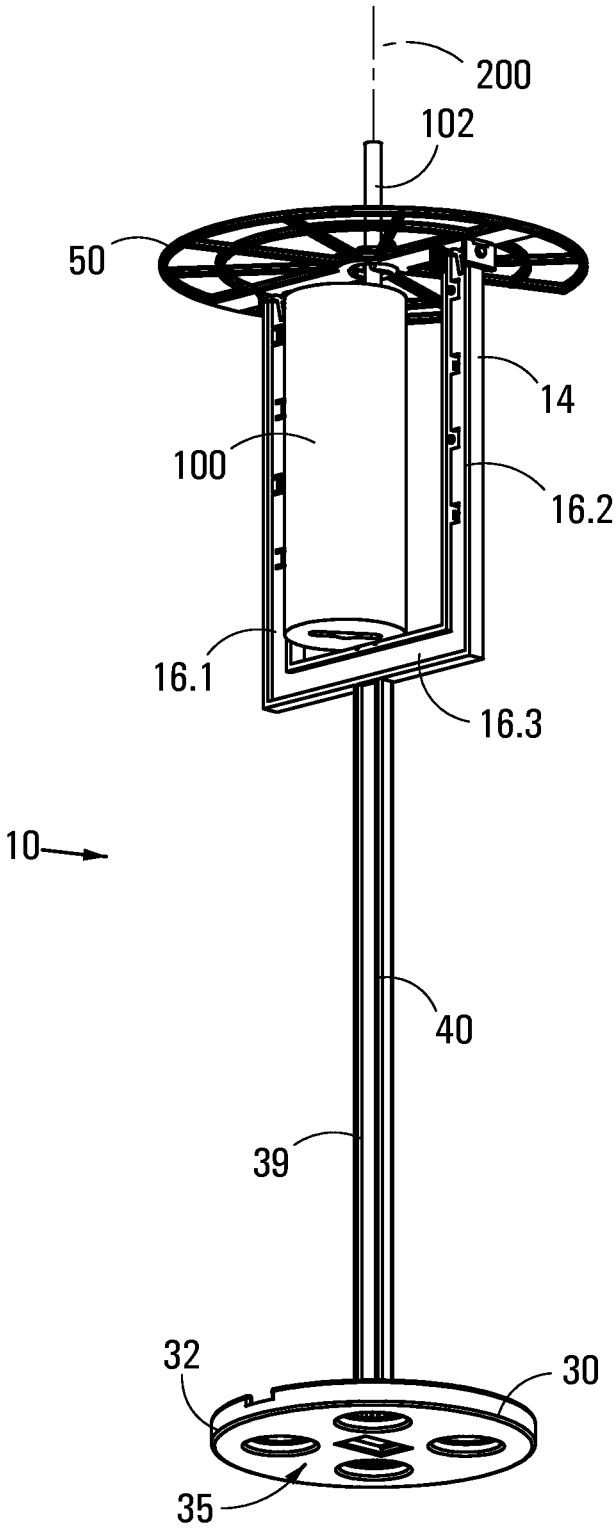
FIG. 8 shows a three-dimensional view of part of the booster explosive support device of FIG. 5.1.
Figure 9:
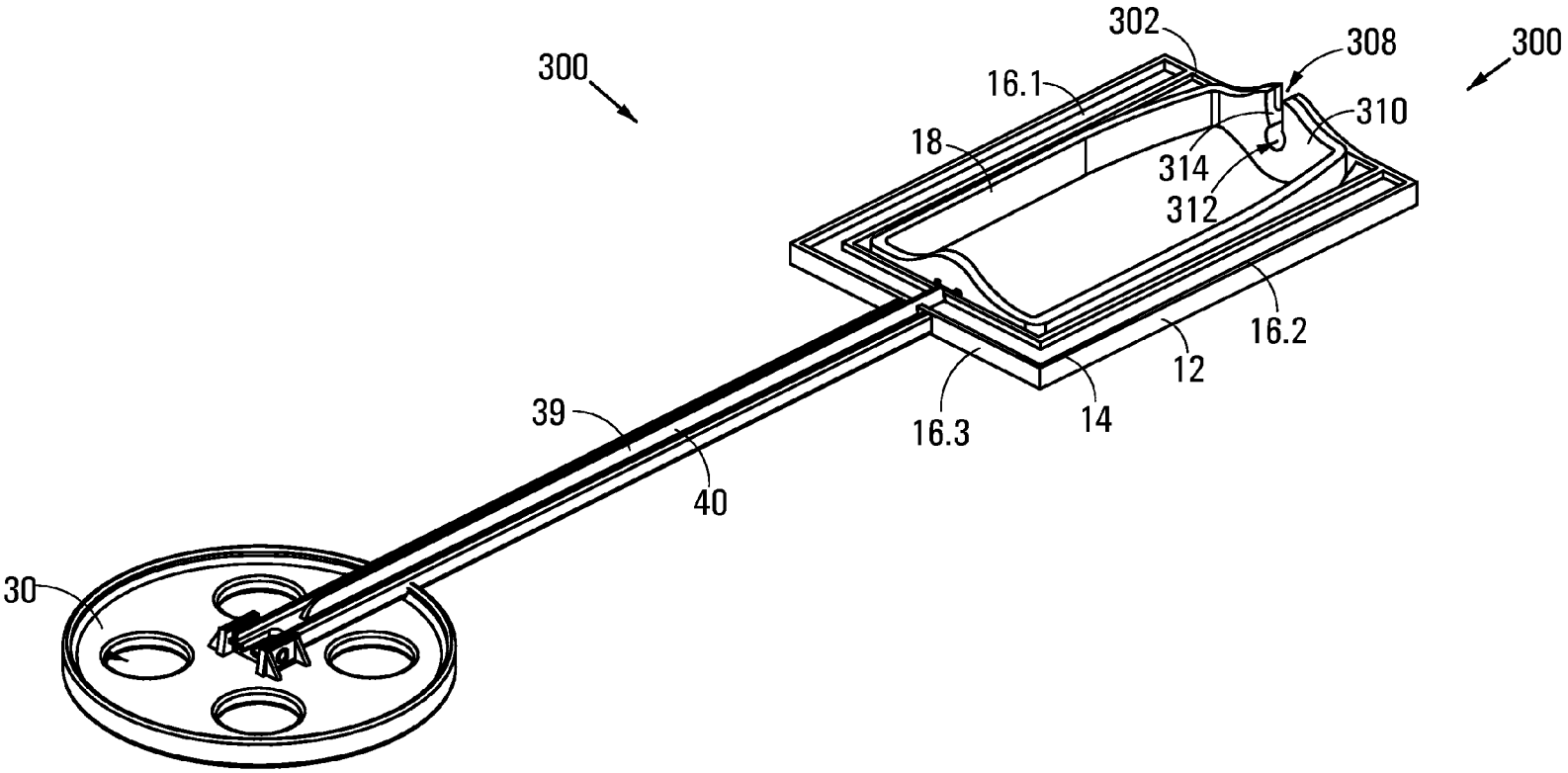
FIG. 9 shows a three-dimensional view of another booster explosive support device in accordance with the invention, in an inoperative, stored condition.

In FIGS. 1 to 8, reference numeral 10 refers generally to a booster explosive support device in accordance with the invention.

The booster explosive support device 10 includes a securing arrangement 12 for securing an explosive booster 100 to the device 10. The securing arrangement 12 includes a U-shaped body 14 which has two parallel limbs 16.1, 16.2 which are interconnected by a transverse member 16.3, the body 14 extending generally in a first plane. The securing arrangement 12 also includes a holder 18 which is rotatably mounted on the member 16.3 for displacement about an axis 200 which lies in the first plane. The holder 18 defines a holding space 22 into which an explosive booster 100 can be loaded or introduced. The holder 18 includes two sidewalls 24.1, 24.2 which define there-between two openings/spaces 26.1, 26.2 through which an explosive booster 100 may be introduced into the holding space 22. The holder 18 is rotatably displaceable relative to the body 14 about the axis 200 between a loading position where the spaces 26.1, 26.2 are positioned between the limbs 16.1, 16.2 in order to allow an explosive booster 100 to be placed in the holding space 22, and a closed position where the spaces 26.1, 26.2 face, or are in register with, the limbs 16.1, 16.2, thereby closing off the holding space 22 and retaining the explosive booster 100 in the holding space 22.

The holder 18 is elongate when seen in axial view along the axis 200. Furthermore, when the holder 18 is in its loading position, a longitudinal axis of the holder 18 is generally parallel to the plane in which the U-shaped body 14 extends, which results in the holder 18 having a relatively slim profile compared to when the holder 18 is in its closed position. When the device 10 is packaged, stored or required to be shipped, the holder 18 is positioned in its loading position (due to its slimmer profile). The loading position of the holder 18 may therefore also be referred to as a stored condition of the holder 18.

The securing arrangement 12 also includes a number of straps 20 (e.g. Velcro® straps) for securing an explosive booster 100 to the securing arrangement 12.

The booster explosive support device 10 also includes a spacing element 39 which protrudes from the securing arrangement 12 in an operatively downward direction. The spacing element 39 includes an elongate stem 40 one end of which is connected to the transverse member 16.3 of the securing arrangement 12; and a foot or anchor formation 30 which is connected to the other end of the stem 40. The stem 40 may be integrally formed with the U-shaped body 14. Although not specifically illustrated, the spacing element 39 may include two elongate parts/members which are displaceable relative to each other in order to allow the distance/spacing between the securing arrangement 12 and the anchor formation 30 to be adjusted, and a securing means for securing the two members relative to each other. More specifically, the spacing element may include an elongate first member, an elongate second member which is telescopically receivable in, and projectable from, the first member, and a securing means which is used to secure the members relative to each other. In one example, the first member can include a series of transverse holes which extend therethrough and which are spaced along the length thereof. The second member can include a transverse hole which extends therethrough and which is alignable with one of the holes in the first member, depending on the amount by which the second member projects from the first member. The securing means can be in the form of a pin which can be slotted through a pair of aligned holes in order to secure the members relative to each other in order to fix the distance/spacing between the securing arrangement 12 and the anchor formation 30. The anchor formation 30 includes a flat, round body 32 which defines an operatively upper anchor surface 34. In alterative embodiments the body 32 may have other geometrical shapes (e.g. rectangular) or may be in the form of upwardly angled prongs. The body 32 also defines a plurality of holes 36 which extend through the body 32 from the operatively upper surface 34 to an operatively lower surface 35 of the body 32. The anchor formation 30 is pivotally attached to the stem 40 in order to allow displacement of the anchor formation 30 relative to the stem 40 between an operative condition (see FIGS. 4.1 to 4.3, 5.1, 5.2 and 8) where the anchor surface 34 faces an operatively upper direction and the flat body 32 extends in a plane which is substantially perpendicular to a longitudinal axis of the stem 40, as well as the plane in which the body 14 extends; and a stored condition (see FIGS. 1 to 3) where the body 32 extends in a plane which is substantially parallel to the longitudinal axis of the stem 40, as well as the plane in which the body 14 extends.

A locating arrangement 50 is pivotally connected to free ends of the limbs 16.1, 16.2. With particular reference to FIGS. 6.1 and 6.2, the locating arrangement 50 has a body 52 which includes two concentric rings 54, 56 which are interconnected, and connected to a central portion 61 of the locating arrangement 50, by means of a central bar 73 and a series of angularly spaced, radially outwardly projecting sector bars 58. A laterally/radially outer portion of the ring 56 forms a locating formation which serves to locate and centre the booster explosive support device 10 in a borehole 87 by engaging with a sidewall 89 of the borehole 87 as the device 10 is lowered down the borehole 87. The ring 56 therefore helps to ensure that the booster explosive support device 10 is located centrally in a borehole 87.

The body 50 also defines a generally triangularly shaped path 60 which leads to the central portion 61 of the locating arrangement 50. The central portion 61 defines a hole 80 through which a downline 102 may extend from a control centre located at the top (i.e. outside the borehole 87) down to a detonator embedded in the booster 100 positioned in the holding space 22. More specifically, the downline 102 is threaded from top to bottom through an open-ended tunnel-like hole in the booster and then pushed back up into a closed-ended parallel tunnel-like hole (see FIG. 7). The central portion 61 includes a locking formation 82 (e.g. a rotatable bushing) which is rotatable between an open position (see FIG. 2) whereby the locking formation 82 allows access to the hole 80 via the path 60 (i.e. allowing a downline 102 to be slid into the hole 80) and a closed/locked position (see FIG. 6.2) whereby access to the hole 80 via the path 60 is inhibited (i.e. to lock a downline 102 in the hole 80).

The locating arrangement 50 is pivotally displaceable relative to the U-shaped body 14 between an operative condition (see FIGS. 4.1 to 4.3, 5.1, 5.2 and 8) whereby the body 52 extends in a plane which is substantially perpendicular to the plane in which the body 14 extends; and a stored condition (see FIGS. 1 to 3) whereby the body 52 extends in a plane which is substantially parallel to the plane in which the body 14 extends.

The booster explosive support device 10 is packaged and/or stored in an inoperative stored condition where the anchor formation 30, locating arrangement 50 and holder 18 are positioned in their respective stored conditions (see FIGS. 1 to 3), thereby resulting in a slim profile when seen in side view, which subsequently results in easy storage and shipping.

When a miner wishes to place the booster explosive support device 10 in a water-containing borehole 87, he/she firstly rotates the locating arrangement 50 and anchor formation 30 to their respective operative conditions. With the locking formation 82 in an open position, he/she then slides the downline 102 into the hole 80 via the path 60 and rotates the locking formation 82 into its locked/closed position. With the holder 18 in its open position, booster 100 is placed into the holding space 22, whereafter the holder 18 is rotated into its closed position, thereby securing the booster 100 to the device 10. If desired, the straps 20 can be used to further secure the booster 100 in position. The procedure described above takes approximately 15 seconds.

The booster explosive support device 10 is then lowered down the borehole 87 by means of the downline 102 until the anchor formation 30 is positioned on a bottom end of the borehole 87 (see FIG. 4.1). As the booster explosive support device 10 is lowered, the ring 56 generally centres the device 10 in the borehole 87, while the holes 36 in the anchor formation 30 facilitates the flow of water 105 past the device 10 as it lowers through the water 105. In order to further facilitate the lowering of the booster explosive support device 10 through the water 105 in the borehole 87, it will have a weight that will cause it to sink. In one embodiment, the booster explosive support device 10 is made of a material which has a greater density than water, or of two or more materials which, in combination, have a greater density than water. When positioned at the bottom end of the borehole 87, the elongate spacing element 39 spaces the securing arrangement 12 operatively upwardly from the bottom end of the borehole 87. The length of the stem 40 will depend on what the desired position for the booster 100 is in the borehole 87. Once the device 10 is in this position, a hose 110 is lowered to a location just above or below the locating arrangement 50 and the pressurised pumping of primary explosive material, which may be an emulsion-based explosive 120, is initiated (see FIG. 4.2) in order to form an explosive column 122 in the borehole 87 and around the device 10 (see FIG. 4.3).

The pressurised pumping of the emulsion based explosive will force the explosive past some of the components of the invention, such as the locating arrangement 50, and will displace the water 105 surrounding the device 10 towards a top or open end 107 of the borehole, thus creating an upward force that tends to lift the device 10 in an operatively upward direction. This lifting action experienced by the device 10 is temporarily suppressed by the hose 110 and nozzle 112 located just above the device 10. Eventually, the continual pumping of the emulsion based explosive 120 will settle above the anchor formation 30 on the anchor surface 34. As a result, the weight and density of the explosive column 122 forming above the anchor surface 34 will impede any lifting of the device 10 towards the open end 107 of the borehole 87. Furthermore, the continuous pumping of the emulsion based explosive 120 will quickly displace all the water surrounding the device 10 and replace it with an explosive column 122, thus ending any lifting action initially created by the displaced water. The device 10, with the booster 100 secured thereto, will therefore remain firmly in place.

The device 10 may in its entirety, be increased or decreased in size proportionally, or by selective parts, in order for it to be adapted for different borehole 87 diameters.

The invention may make use of an electronic detonator which is positioned in the explosive booster. The advantage of an electronic detonator is its precise timing. An integrated circuit chip and capacitor internal to each detonator controls the initiation time. A specially designed blasting machine or control centre can transmit a selectable signal that is identified by each detonator and determine the detonation timing sequence.

The fact that the anchor formation 30, the locating arrangement 50 and holder 18 are rotatable/pivotable into stored conditions which results in the device 10 having a generally slim profile (see FIG. 3), will aid in the storage, packaging and shipping of the device 10.

The anchor surface 34 can also serve as a temporary storage space for weight bearing material, such as sand, in the event that it is required to aid the device 10 to be lowered down through the water 105 in the borehole 87. This is usually only required if the water 105 in the borehole 87 is heavily contaminated with material such as coal, dust, soil, sediment, and/or other similar material.

FIGS. 9 to 12 illustrate an alternative embodiment of the booster explosive support device 300 in accordance with the invention. The explosive support device 300 is in many respects similar to the booster explosive support device 10 illustrated in FIGS. 1 to 8 and the reference numerals used in those figures to indicate specific parts are also used to identify similar parts in FIGS. 9 to 12. The main difference in this embodiment is that the explosive support device 300 does not have a locating arrangement 50.

In this embodiment, the body 14 includes an elongate connecting plate/member 302 which interconnects the free ends of the limbs 16.1 16.2, i.e the ends remote from the member 16.3. The holder 18 is rotatably mounted to, and between, the member 16.3 and the connecting member 302 for displacement about an axis 400. A central portion 304 of the connecting member 302 defines a hole 306 (see FIG. 12) and an open-ended slot 308 which leads from the hole 306 to a lateral side of the connecting member 302. An upper part 310 of the holder 18 includes a generally cylindrical stub 311 (see FIG. 12) which projects upwardly through the hole 306 in the connecting member 302 in order to provide the rotational connection between the holder 18 and the connecting member 302. The holder 18 defines a hole 312 which extends through the stub 311. Similar to the connecting member 302, the upper part 310 of the holder 18 defines an open-ended slot 314 which leads from the hole 312 to a lateral side of the holder 18. The two holes 306, 312 together define a path through which a downline 102 may extend.

Figure 10:
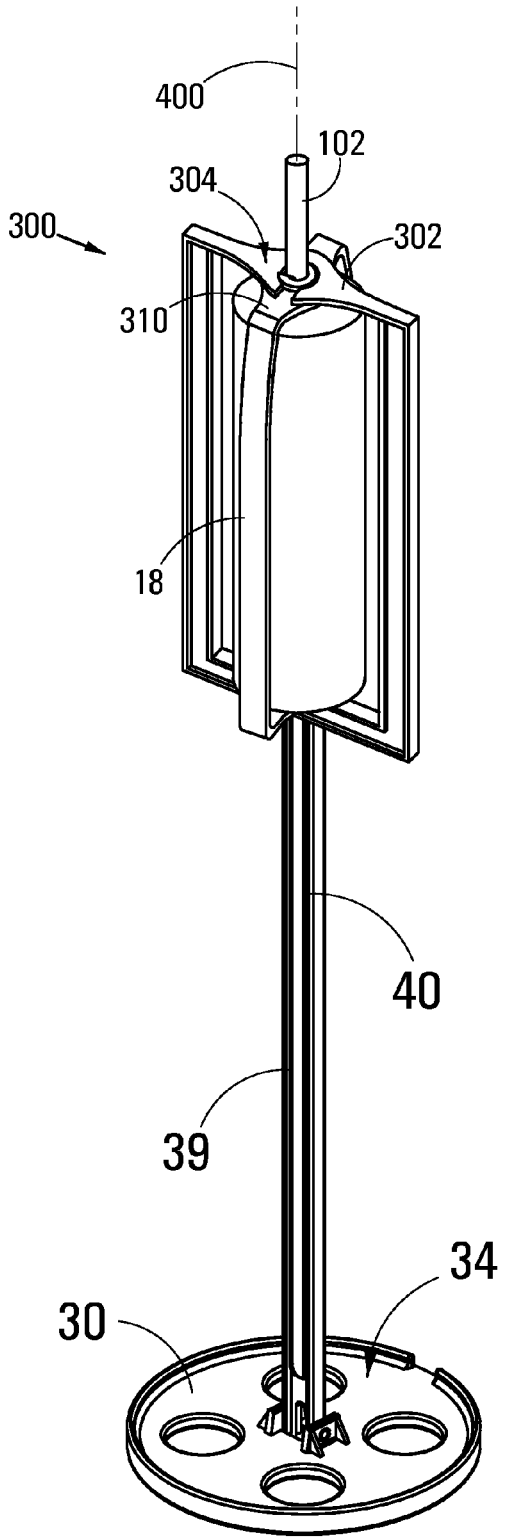
FIG. 10 shows a three-dimensional view of the booster explosive support device of FIG. 9 in an operative condition.
Figure 11:
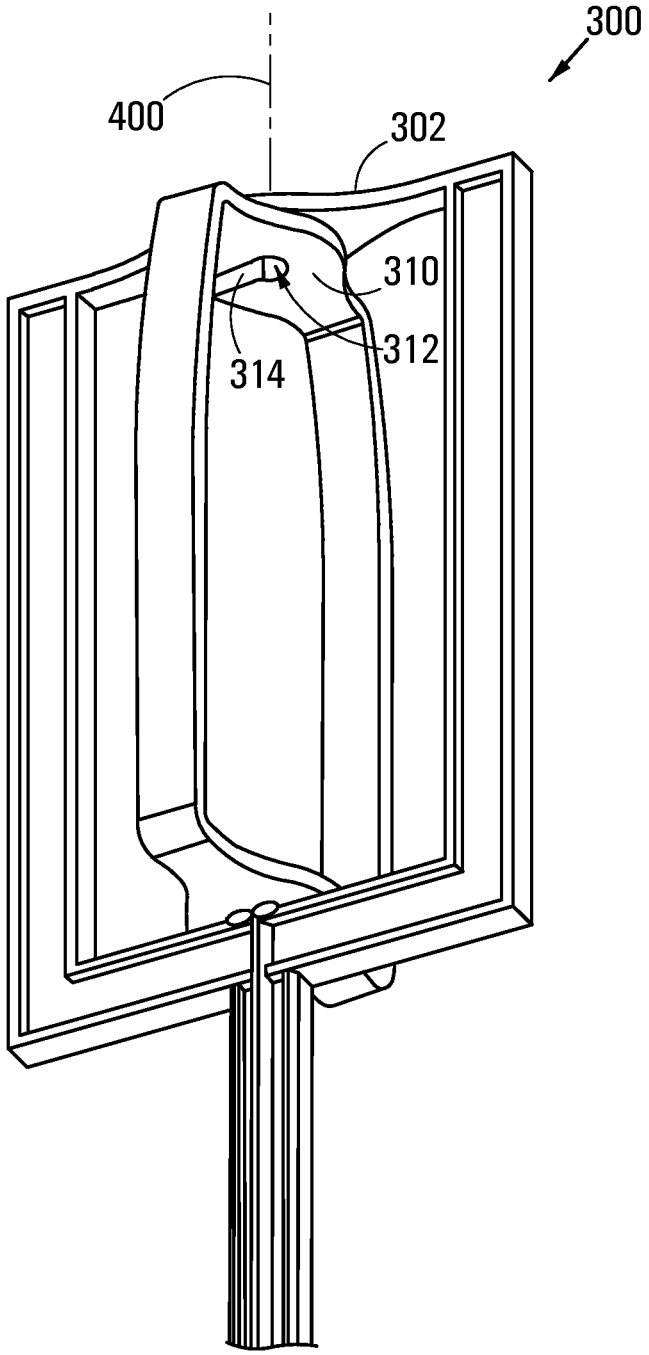
FIG. 11 shows an enlarged three-dimensional view of part of the booster explosive support device of FIG. 10.
Figure 12:
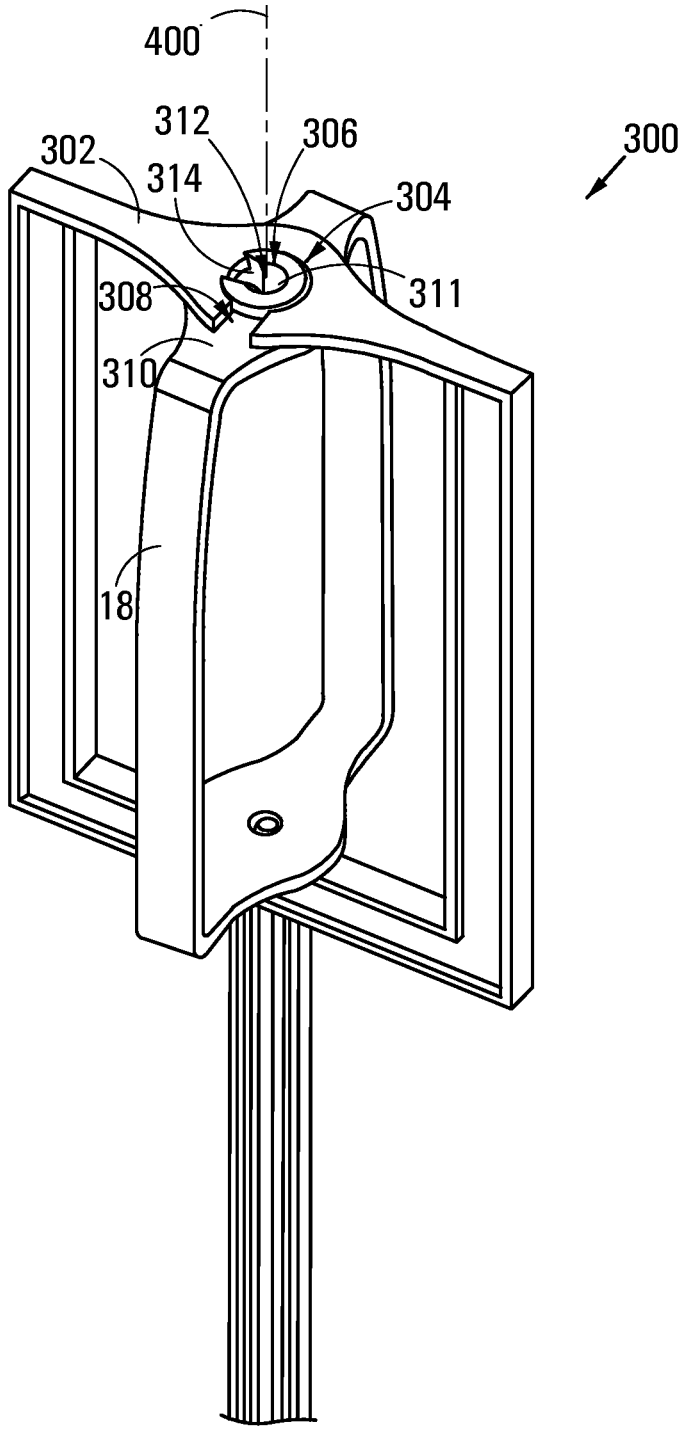
FIG. 12 shows another enlarged three-dimensional view of part of the booster explosive support device of FIG. 10.

The holder 18 is rotatable relative to the body 14 about the axis 400 between its loading position (see FIG. 9) and closed position (see FIGS. 10 to 12). In the loading position, the slots 308, 314 are aligned/in register with each other in order to allow a downline 102 to be slotted into the path defined by the two holes 306, 212 via the aligned slots 308, 314. In the closed position, the slots 308, 314 are out of register with each other and the path defined by the two slots 308, 314 is closed off so that the downline 102 extends through and is held captive in the holes 306, 312.

The Inventors believe that the booster explosive support device 10, 300 is relatively inexpensive, light and easy to operate. The device 10, 300 is also effective in keeping the booster 100 located firmly and securely at the location originally designed by the loading crew.

Furthermore, the device 10 also helps ensure an optimised return of the initiation booster, since the locating arrangement 50 ensures that the booster 100 is located away from the side walls 89 of a borehole 87, in order to allow the booster 100 to be completely surrounded with explosive material such as an emulsion based explosive 120. This optimises the effectiveness of the booster in utilizing its released energy in detonating the surrounding explosive column 122.

Furthermore, with the device 10, 300 preventing the need to suspend the booster 100 by means of a downline, there is no longer need for tension in the downline once the device 10 is positioned in the borehole 87. This will therefore reduce, or even eliminate, the technical problems identified in the background of the specification regarding the downline.

The invention claimed is:

1. A booster explosive support device for use in boreholes, the device including:

a securing arrangement configured to secure an explosive booster to the device; and an elongate spacing element which protrudes from the securing arrangement, the spacing element having a free end which in use abuts against a closed end or bottom of a borehole thereby supporting the securing arrangement and hence an explosive booster at a desired spacing from the bottom of the borehole, the elongate spacing element including an elongate stem, one end of which is connected to the securing arrangement, and a foot or anchor formation connected to the other end of the stem, the foot, or anchor formation defining an operatively upper anchor surface onto which primary explosive material can be introduced when the device is positioned in a borehole, in order to aid in securing/anchoring the device in the borehole.

2. The booster explosive support device of claim 1, wherein the spacing element is length-adjustable in order to allow the distance/spacing between the securing arrangement and the free end of the spacing element to be adjusted.

3. The booster explosive support device of claim 1, wherein the anchor formation includes an anchor body defining the anchor surface and at least one hole which extends through the anchor body from the anchor surface.

4. The booster explosive support device of claim 3, wherein the anchor body defines a plurality of holes.

5. The booster explosive support device of claim 1, wherein the anchor formation is displaceably attached to the stem in order to render the anchor formation displaceable relative to the stem between an operative condition where the anchor surface faces an operatively upper direction and a stored condition where the anchor surface faces a direction transverse to the operatively upper direction, the anchor surface extending in a plane which is parallel to a longitudinal axis of the stem, when the anchor formation is in its stored condition.

6. The booster explosive support device of claim 5, wherein the anchor formation is pivotally attached to the stem.

7. The booster explosive support device of claim 1, wherein the securing arrangement includes a securing body and a holder, defining a holding space, which is displaceably mounted to the securing body in order to allow displacement of the holder relative to the securing body between a loading position where an explosive booster can be loaded/introduced into the holding space and a closed position in which the explosive booster is held captive in the holding space.

8. The booster explosive support device of claim 7, wherein the holder is rotatably mounted to the securing body about an axis of rotation which is parallel to a longitudinal axis of the spacing element or the stem thereof.

9. The booster explosive support device of claim 8, wherein the holder is elongate, when seen in axial view along the axis of rotation of the holder.

10. The booster explosive support device of claim 1, wherein the securing arrangement includes at least one strap for securing an explosive booster to the booster explosive support device.

11. The booster explosive support device of claim 1, which includes a locating arrangement including a body having an operatively lateral locating surface which serves to locate the booster explosive support device in a borehole, the body of the locating arrangement being flat and, in use, extending in a plane which is perpendicular to a longitudinal axis of the spacing element or the stem thereof.

12. The booster explosive support device of claim 11, wherein the locating arrangement is pivotally connected to the securing arrangement in order to allow displacement of the locating arrangement relative to the securing arrangement between an operative condition whereby the locating body extends in a plane which is perpendicular to the longitudinal axis of the spacing element or the stem thereof; and a stored condition whereby the locating body extends in a plane which is parallel to the longitudinal axis of the spacing element or the stem thereof.

13. The booster explosive support device of claim 11, wherein the locating arrangement is connected to the securing arrangement and positioned above an operatively upper portion thereof, the locating arrangement defining a hole through which a downline can be introduced which, in use, leads to, and is connected to, a detonator which is located close to, or embedded in, an explosive booster which is secured to the securing arrangement, the locating arrangement defining a path leading to the hole and include a locking formation which is moveable between an open position whereby the locking formation allows access to the hole via the path and a closed/locked position whereby access to the hole via the path is inhibited.

14. The booster explosive support device of claim 1, which is made of a material which has a greater density than water, or of two or more materials which, in combination, have a greater density than water.

15. A method of securing an explosive booster at a pre-determined position in a borehole, the method including spacing the explosive booster away from a closed end of the borehole by supporting the explosive booster from an operatively lower position thereof, wherein the spacing of the explosive booster away from the closed end of the borehole is achieved by positioning an elongate spacing element which includes an elongate stem and a foot or anchor formation connected to a distal end of the stem, between the booster and the closed end of the borehole with the anchor formation in abutment with the closed end of the borehole.

16. The method of claim 15, wherein a spacing distance of the explosive booster from the closed end of the borehole corresponds to the pre-determined position in which the explosive booster is required to be in.

17. The method of claim 15, which is for securing an explosive booster, together with a detonator, at a pre-determined position in a borehole.

18. The method of claim 17, wherein the detonator is an electronic detonator.

19. A booster explosive support device for use in boreholes, the device including:

a securing arrangement configured to secure an explosive booster to the device; and a spacing element which protrudes from the securing arrangement, the spacing element having a free end which in use abuts against a closed end or bottom of a borehole thereby supporting the securing arrangement and hence an explosive booster at a desired spacing from the bottom of the borehole, wherein the securing arrangement includes at least one strap for securing an explosive booster to the booster explosive support device.

* * * * *